US006332241B1

(12) United States Patent
Kuo

(10) Patent No.: US 6,332,241 B1
(45) Date of Patent: Dec. 25, 2001

(54) LOCKING DEVICE FOR RETRACTABLE HANDLE OF WHEELED LUGGAGE

(75) Inventor: Chung-Hsien Kuo, Pan-Chiao (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 09/543,563

(22) Filed: Apr. 5, 2000

(30) Foreign Application Priority Data

Sep. 10, 1999 (TW) ..... 88215510 U

(51) Int. Cl.[7] ..... B65D 25/28; E05B 1/00
(52) U.S. Cl. ..... 16/113.1; 16/405; 16/429
(58) Field of Search ..... 16/113.1, 405, 16/429

(56) References Cited

U.S. PATENT DOCUMENTS 5,488,756 * 2/1996 Hsieh ..... 16/115
5,620,070 * 4/1997 Wang ..... 190/115
5,628,088 * 5/1997 Chen ..... 16/115
5,636,410 * 6/1997 Chou ..... 16/115
5,653,000 * 8/1997 Lee ..... 16/115
5,692,266 * 12/1997 Tsai ..... 16/115
5,956,807 * 9/1999 Kuo ..... 16/115
6,026,543 * 2/2000 Chen ..... 16/113.1
6,122,800 * 9/2000 Cheng ..... 16/113.1
6,128,806 * 10/2000 Shou-Mao ..... 16/113.1
6,134,749 * 10/2000 Kuo ..... 16/113.1
6,141,828 * 11/2000 Kuo ..... 16/113.1
6,148,477 * 11/2000 Cheng ..... 16/113.1
6,161,253 * 12/2000 Tu ..... 16/113.1
6,163,925 * 12/2000 Lin ..... 16/113.1

* cited by examiner

*Primary Examiner*—Lynne H. Browne
*Assistant Examiner*—John B. Walsh
(74) *Attorney, Agent, or Firm*—Dougherty & Troxell

(57) ABSTRACT

A handle assembly of wheeled luggage comprises a handle grip with a push button, two first sliding tubes, at least one pair of second sliding tubes, two support tubes, two first locking devices each provided below each first sliding tube, at least one pair of second locking devices each provided below each second sliding tube, a pair of first cables attached between handle grip and first locking devices, and at least one pair of second cables for controlling second locking devices wherein the length of fully extended handle is longer than the height of luggage for providing a handle with extended sufficient length to the user when towing a small luggage along the ground.

7 Claims, 10 Drawing Sheets

10
11
12
10
211
212
13
22
14
20
20
215
217
23
24
213
210
21
581
30
240
241
23
214
215
22
245
221
58
42
31
40
45
30
33
32
43
42
42
572
44
46
40
582
571
58
47
57
50
43
574
575
521
551
576
44
54
53
55
56
5532
511
550
57
60
51
54
577
56
512
53
573
553
542
541
5532
52
5531
553
5531
62
523
50
55
61
60
63
62
70
72
71
73
72
70
76
74
75

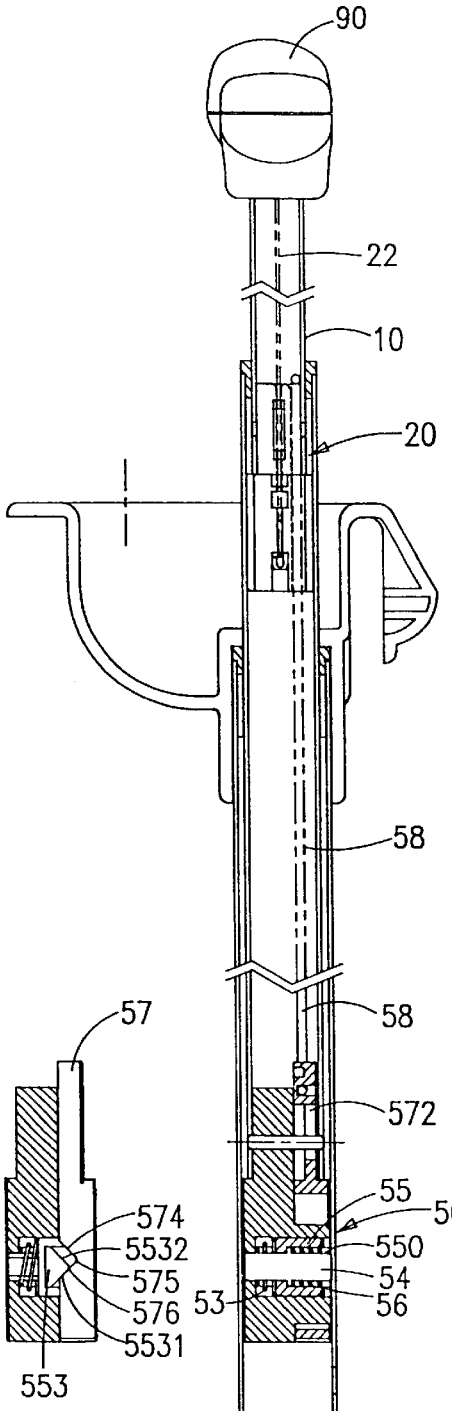
FIG. 4
FIG. 6B
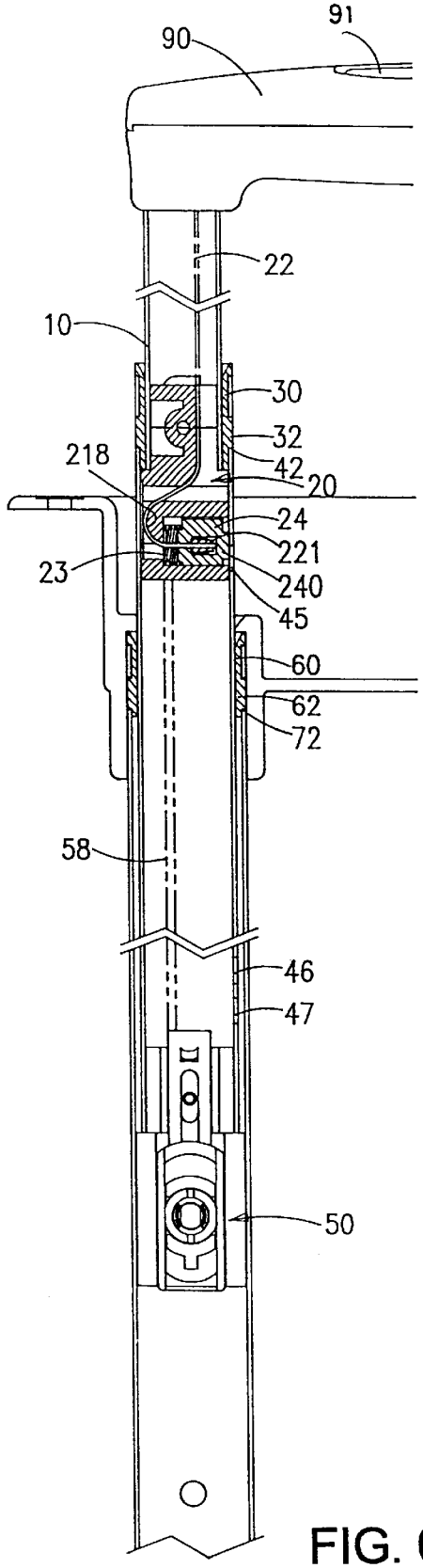
FIG. 6A

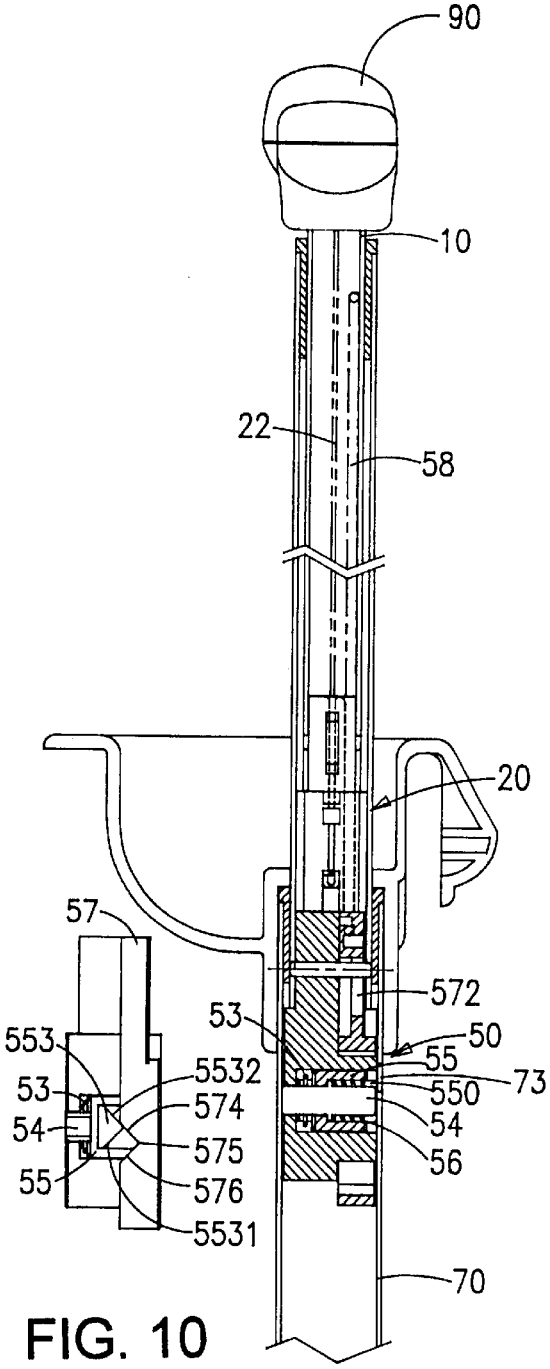
FIG. 10
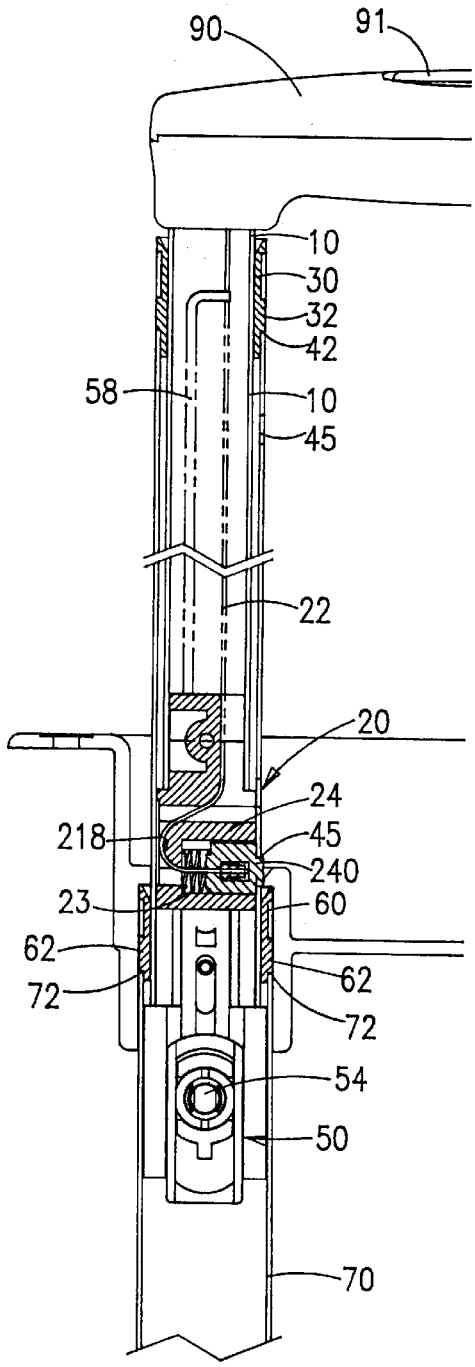
FIG. 9B
FIG. 9A

LOCKING DEVICE FOR RETRACTABLE HANDLE OF WHEELED LUGGAGE

BACKGROUND OF THE INVENTION

1. Field of the Invention

The present invention relates to a retractable handle for wheeled luggage and more particularly to a locking device for retractable handle of wheeled luggage.

2. Description of Related Art

Conventionally, only one locking device is provided in the retractable handle for controlling the handle in a retracted position and an extended position. Further, it is also possible to design the sliding tube to be engaged with the support tube in a plurality of retaining slots of the support tube for varying the length of retractable handle. It is known that the maximum length of the retractable handle is less than that of the height of luggage case. In addition, the airline industry has strictly enforced the restriction on the dimension of carry-on luggage that may be brought onboard of an airplane. As such, in one case that the total height of the height of luggage plus the length of fully extended handle is still less than the distance between hand of an upright person and ground. This means that the person has to bend his/her back to reach and tow the handle grip. It can be seen that such design is not convenient.

Furthermore, it is necessary to retract the handle to its lowest position in order to carry the luggage in and out of various forms of carriers such as airplanes or motor vehicles. However, the center line of handle grip tends to tilt away from the center line of luggage when luggage is lifted, i.e., the lower portion of luggage is nearer the user than the top portion thereof. As such, luggage may interfere with the user's movement or walking.

SUMMARY OF THE INVENTION

It is thus an object of the present invention to provide a multi-locking device for retractable handle of wheeled luggage for eliminating the disadvantages of prior art.

It is another object of the present invention to provide a locking device for retractable handle of wheeled luggage wherein the length of fully extended handle is longer than the height of luggage for providing a handle with extended sufficient length to the user when towing a small luggage along the ground.

It is another object of the present invention to provide a locking device for retractable handle of wheeled luggage wherein handle grip can be pulled a small sufficient distance above the recess on top of luggage and locked therein so as to provide a great convenience to the user when lifting luggage.

It is still another object of the present invention to provide a locking device for retractable handle of wheeled luggage wherein the length of handle may be varied for conforming to a tall person.

To achieve the above and other objects, the present invention provides a handle assembly of wheeled luggage having two identical parts each comprising: a first sliding tube; a first locking device detachably attached to the bottom of the first sliding tube; a second sliding tube for allowing the first sliding tube to slidingly move therein having a plurality of holes; a second locking device detachably attached to the bottom of the second sliding tube; and a support tube for allowing the second sliding tube to slidingly move therein having a plurality of holes.

Whereby the handle is retracted when the push button is not pressed. The first sliding tube is received in the second sliding tube and the second sliding tube is received in support tube. Projection is biased by spring to engage with lower hole of the second sliding tube. The bottom of first locking device is biased against the top of sliding block of second locking device so as to cling the first end of lock pin to lower hole of support tube, whereby handle is locked in a retracted position. The push button is pressed. Then handle is pulled upward to cause flexible steel cable to move upward so as to bias spring and guide pin to move into lower hole. Grasp handle grip to pull first sliding tube upward for separating bottom of first locking device from top of second locking device. Then top of sliding block being vertically slidable on second locking device is not biased by bottom of first locking device. Sleeve is pushed to the right by the expansion of spring to cause lower slopes of triangular projections to engage against lower slope of the sliding block. Then sliding block moves up to cause lock pin to move to the right to dear lower hole of support tube. Once first sliding tube is pulled up to cause projection of locking block to come into middle hole to lock therein, first sliding tube no longer moves up along the second sliding tube. Then first sliding tube and second sliding tube together move up until the lock pin of second locking device comes into engagement with middle hole of support tube and locks therein. At this time handle is pulled up a small distance above the top of luggage. First and second locking device are unlocked simultaneously when push button is pressed again. Locking block moves up to come into engagement with upper hole of second sliding tube. Handle grip continuously moves up to cause flexible steel cable previously caught in the retaining groove of the first housing below the first sliding tube to move up along with first sliding tube. Then second sliding tube and second locking device move up until lock pin comes into contact with upper hole and locks therein. Now handle is in a fully extended position for allowing luggage to be towed along the ground.

To the contrary, press push button to retract handle which in turn causes pin of locking block attached to flexible steel cable to escape engagement with upper hole of second sliding tube. Whereby first sliding tube may receive within second sliding tube until bottom of first locking device comes into contact with top of sliding block. Then upper slopes of sliding block engages with upper slopes of triangular projections to cause lock pin of second locking device to clear upper hole of support tube. Pin dears upper hole of second sliding tube when push button is pressed again. Then first sliding tube may receive in second sliding tube and second sliding tube may receive in support tube. Now the handle is fully retracted.

The above and other objects, features and advantages of the present invention will become apparent from the following detailed description taken with the accompanying drawings.

BRIEF DESCRIPTION OF THE DRAWINGS

FIG. 4 is a greatly enlarged fragmentary view showing the operation of second locking device;

FIGS. 6A and 6B are similar to FIGS. 5A and 5B respectively, push button being pressed again;

FIGS. 9A and 9B are first and second sectional views respectively showing first locking device locked in lower hole of second sliding tube when push button is pressed, the bottom of second sliding tube is urged against the top of second locking device such that second locking device is released for allowing handle to retract continuously;

FIG. 10 is a greatly enlarged fragmentary view showing second locking device being pressed;

DETAILED DESCRIPTION OF THE PREFERRED EMBODIMENTS

Figure 1:
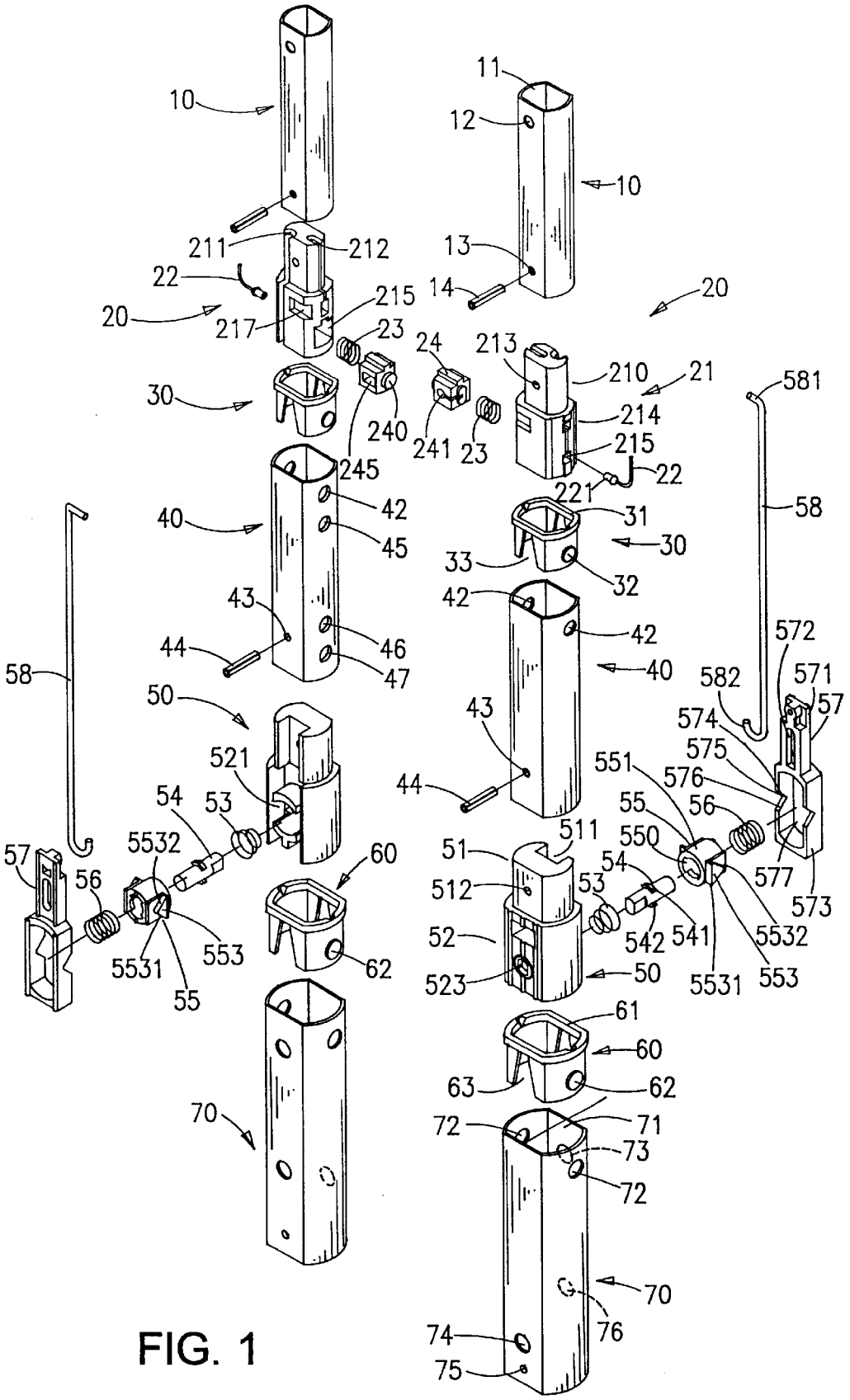
FIG. 1 is an exploded view of a first preferred embodiment of a locking device for retractable handle of wheeled luggage of the invention.

Referring to FIG. 1, there is shown a multi-locking device for retractable handle of wheeled luggage constructed in accordance with the invention wherein handle system is provided on the back of luggage with a handle grip received in a bezel on top of luggage.

Note that because the handle system is bilaterally symmetrical so that description of one side serves to describe the entirety. Thus the handle system of the invention comprises: a first sliding tube 10 having a lower hole 13 and an upper hole 12 attached to one end of handle grip (not shown) by a known fastener; a first locking device 20 detachably attached to the bottom of first sliding tube 10; a second sliding tube 40 for allowing first sliding tube 10 to slidingly move therein having upper, middle, and lower holes 45, 46, and 47 on a first side, two top apertures 42 on first and third sides, and a pin hole 43 on a second side; a first sleeve member 30 provided on the top of second sliding tube 40 having two detents 32 provided on two opposing sides matingly engaged with apertures 42 of second sliding tube 40; a second locking device 50 detachably attached to the bottom of the second sliding tube 40 being secured to the pin hole 43 of second sliding tube 40 by a pin 44; a support tube 70 for allowing second sliding tube 40 to slidingly move therein having upper, middle, and lower holes 73, 76, and 74 on second and fourth sides, respectively, two apertures 72 on a second and a third sides, and a spin hole 75 below the lower hole 74; and a second sleeve member 60 provided on the top of support tube 70 having two detents 62 provided on two opposing sides matingly engaged with apertures 72 of support tube 70.

The first locking device 20 comprises: a first housing 21 having an upper portion 210 with a guide groove 212, a retaining groove 211, and a pin hole 213 such that pin 14 may insert through lower hole 13 of first sliding tube 10 and pin hole 213 to secure first locking device 20 and first sliding tube 10 together; and a lower portion 214 with a cavity 215 and a smoothly curved portion 218 (FIG. 2); a spring 23 provided in the cavity 215 of first housing 21; a locking block 24 provided in the cavity 215 of first housing 21 having a projection 240 on a first side, an aperture 241 on a second side, and an opening 245 in communication with the aperture 241; and a flexible steel cable 22 having an enlargement on one end (not shown) being secured to handle grip and an enlargement 221 on the other end being secured in the opening 245 through the guide groove 212, the smoothly curved portion 218, cavity 215 (FIG. 2), and aperture 241 such that a pressing of the push button may be transmitted to first locking device 20 through the movement of flexible steel cable 22.

The second locking device 50 comprises: an upper portion 51 having a groove 511, a pin hole 512 such that pin 44 may insert through lower hole 43 of second sliding tube 40 and pin hole 512 to secure second locking device 50 and second sliding tube 40 together; and a lower portion 52 having a central dent 521 and a smaller aperture 523 on the bottom of dent 521; a sliding block 57 being slidable along groove 511 and dent 521 having an upper portion 571 with an elongate groove 572 and a lower portion 573 wider than the upper portion 571; a rectangular recess 577 formed on the lower portion 573 being adjacent the upper portion 571 having two V-shaped recesses 575 located on two opposing sides each V-shaped recess 575 having an upper slope 574 and a lower slope 576; a cone-shaped spring 53 with one end biased against smaller aperture 523 of the lower portion 52; a lock pin 54 slidingly moved in dent 521 having two opposing projections 541 and 542 being inserted into cone-shaped spring 53 and secured in the smaller aperture 523; a sleeve 55 slidingly moved in dent 521 with one end biased against cone-shaped spring 53, lock pin 54 slidable in the sleeve 55, two opposing triangular projections 553 formed on the outer surface of the sleeve 55 for matingly engaged with V-shaped recesses 575 having a lower slope 5531 and an upper slope 5532; a spring 56 put on lock pin 54 being received in sleeve 55; and a stem member 58 having a top end 581 clung to the retaining groove 211 of the first housing 21 and a bottom end 582 clung to elongate groove 572.

The following is a description of the operation of handle system.

Figure 2B:
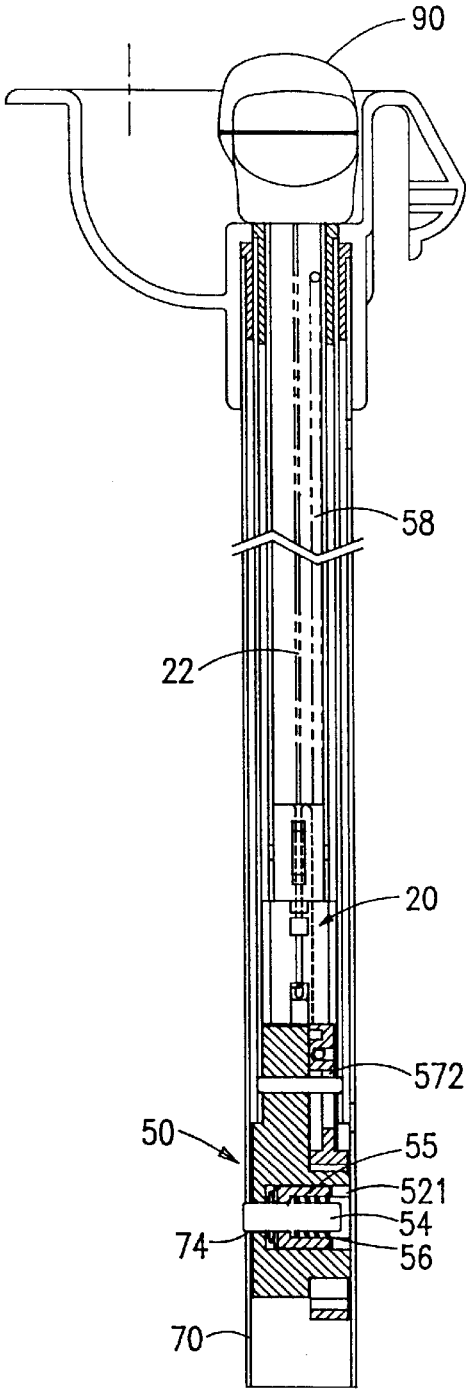
FIGS. 2A and 2B are first and second sectional views showing retracted positions of the fully retracted handle respectively.
Figure 2A:
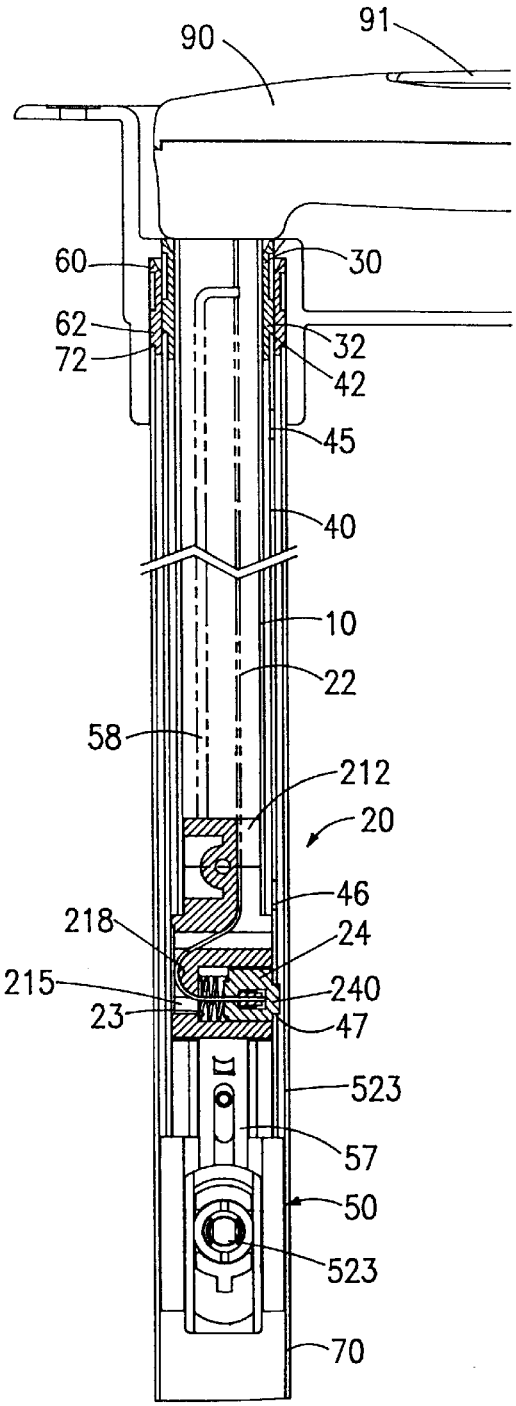
Figure 3B:
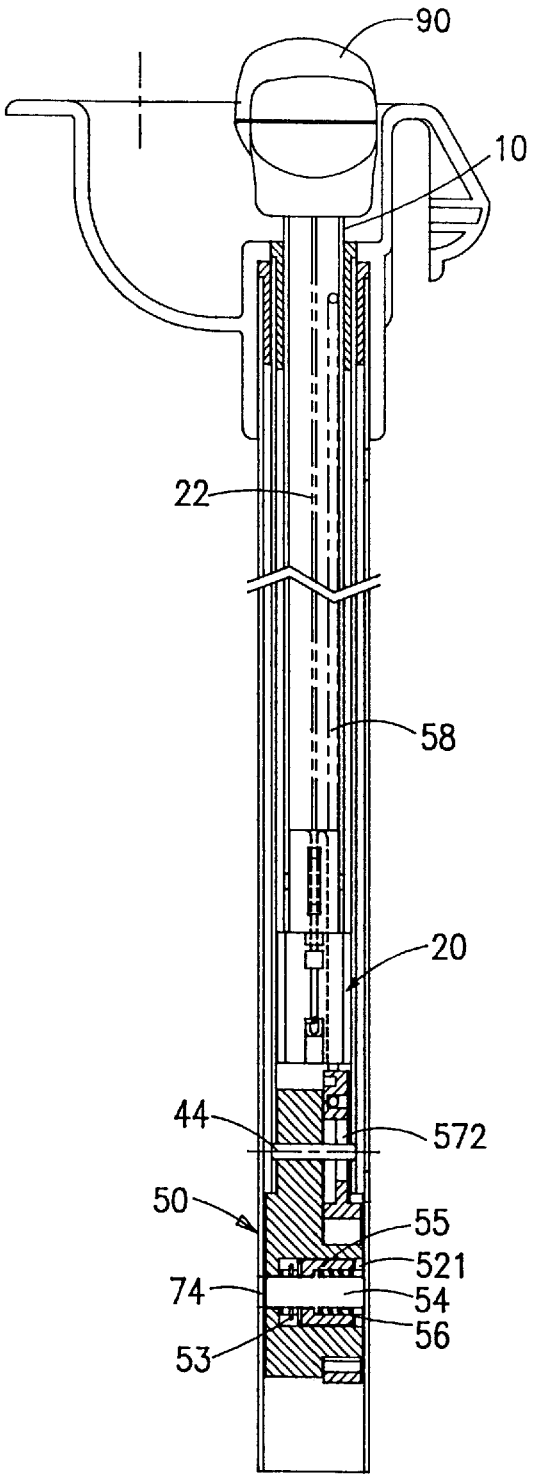
FIGS. 3A and 3B are similar to FIGS. 2A and 2B respectively, push button being pressed.
Figure 3A:
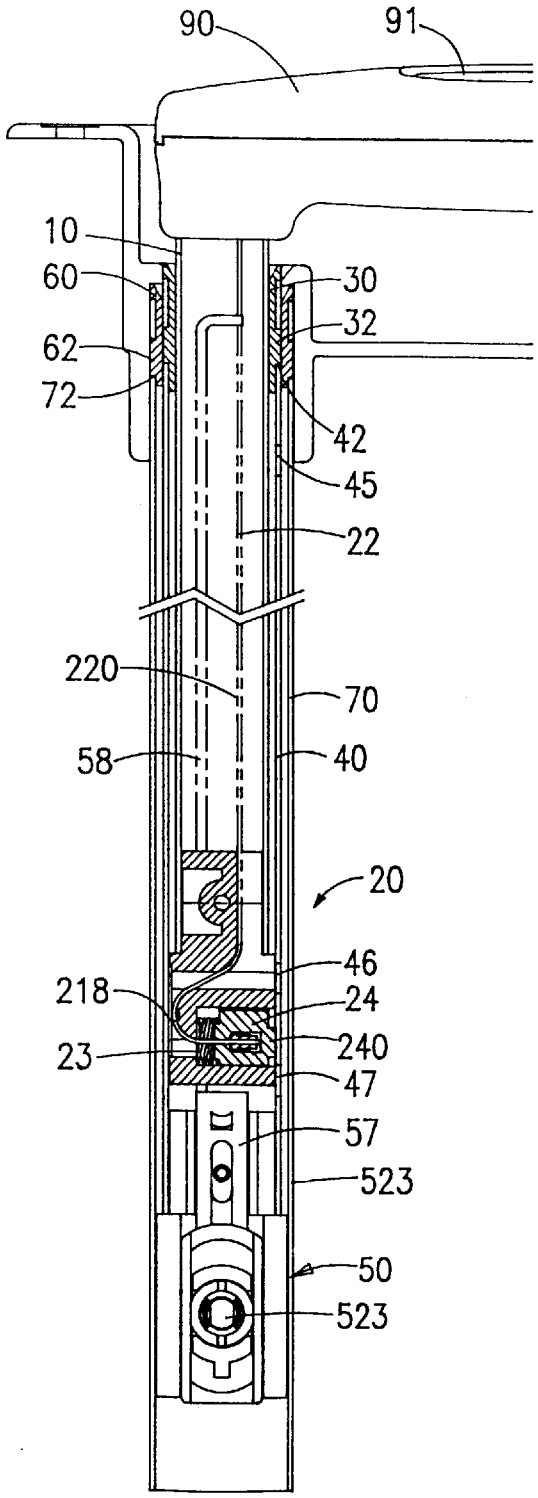
Figure 5B:
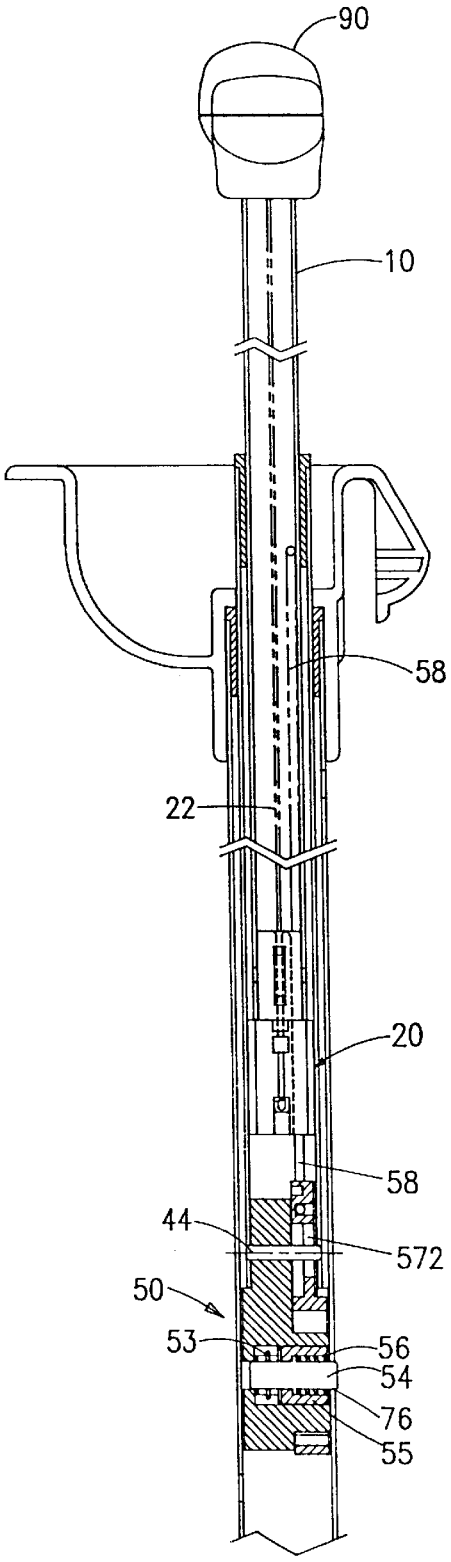
FIGS. 5A and 5B are first and second sectional views showing handle lifted a small distance above the top of luggage.
Figure 5A:
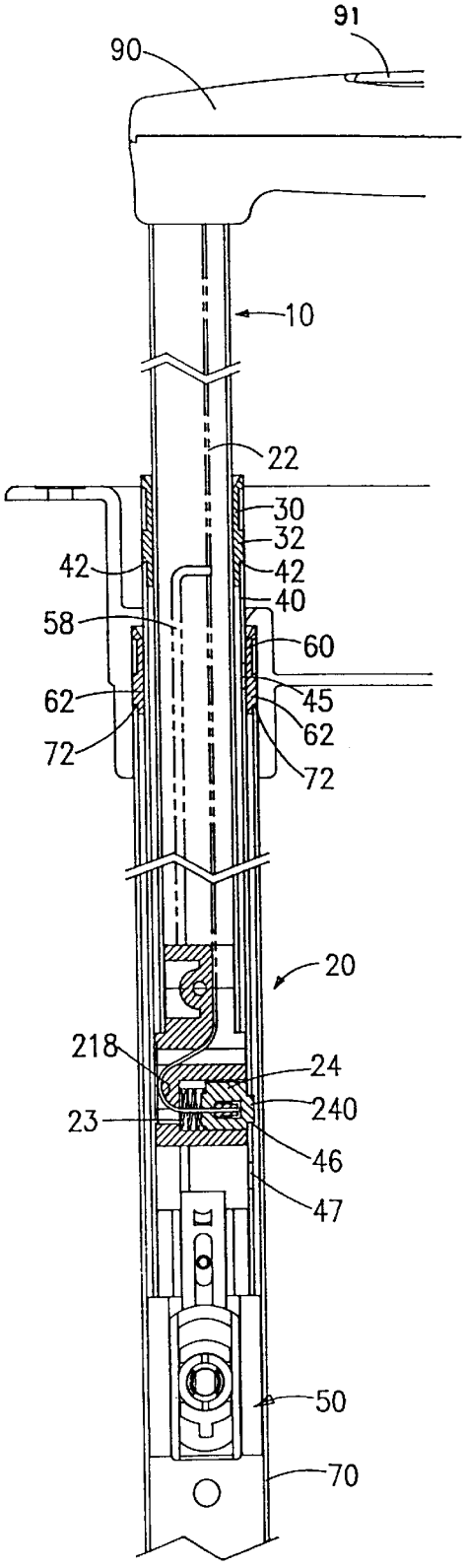
Figure 7B:
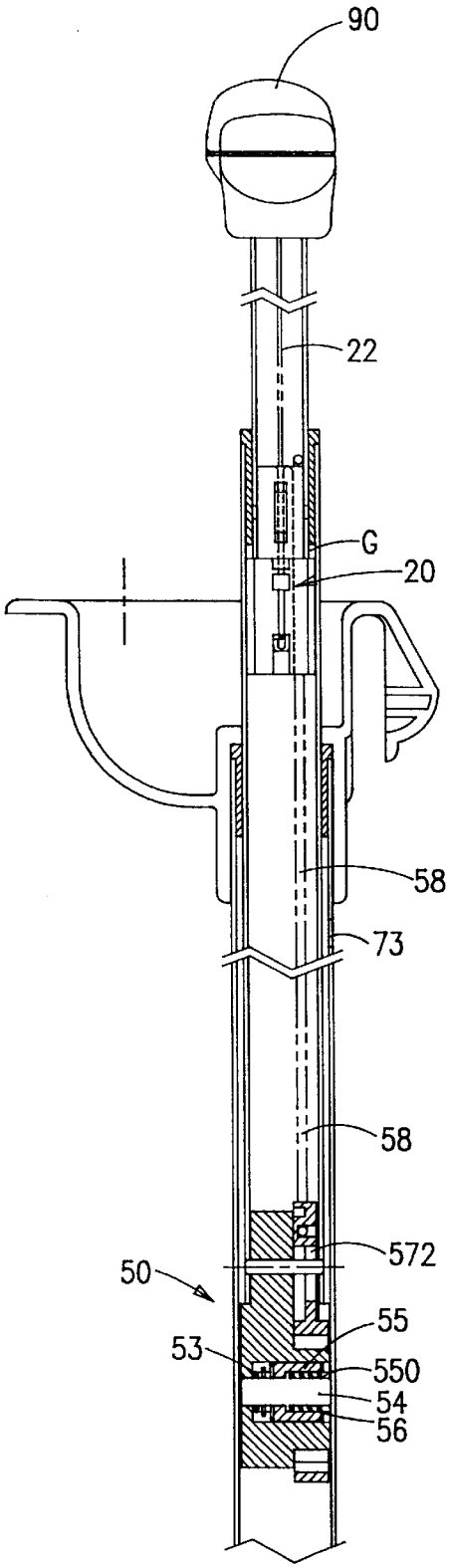
FIGS. 7A and 7B are first and second sectional views respectively showing first locking device locked in upper hole of second sliding tube and second locking device is unlocked.
Figure 7A:
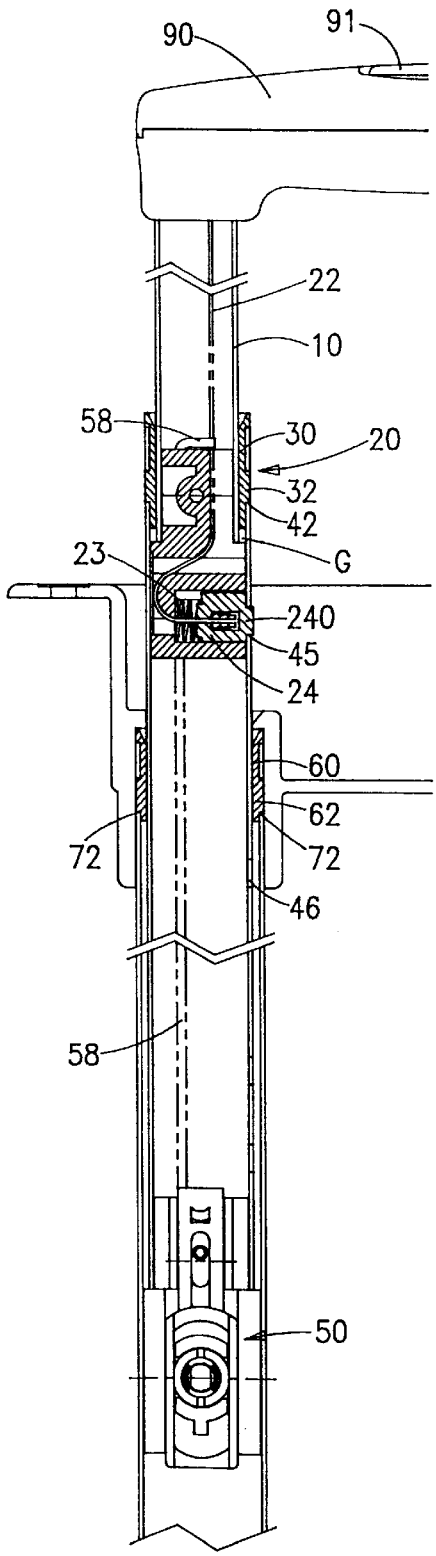

Referring to FIGS. 2A–10, handle is retracted when push button 91 is not pressed (FIGS. 2A and 2B). First sliding tube 10 is received in second sliding tube 40 and second sliding tube 40 is received in support tube 70. Projection 240 is biased by spring 23 to engage with lower hole 47 of second sliding tube 40. The bottom of first locking device 20 is biased against the top of sliding block 57 of second locking device 50 so as to cling the first end of lock pin 54 to lower hole 74 of support tube 70, whereby handle is locked in a retracted position. The push button 91 is pressed as shown in FIGS. 3A–3B. Then handle is pulled upward to cause the flexible steel cable 22 to move upward so as to bias spring 23 and guide pin 240 to move into lower hole 47 (FIG. 3A). Grasp handle grip 90 to pull first sliding tube 10 upward for separating bottom of first locking device 20 from top of second locking device 50. At this time top of sliding block 57 being vertically slidable on second locking device 50 is not biased by bottom of first locking device 20. Sleeve 55 is pushed to the right by the expansion of spring 53 to cause lower slopes 5531 of triangular projections 553 to engage against lower slope 576 of the sliding block 57 (FIG. 4). Then sliding block 57 moves up to cause lock pin 54 to move to the right to clear lower hole 74 of support tube 70 (FIG. 3B). Once first sliding tube 10 is pulled up to cause projection 240 of locking block 24 to come into middle hole 46 to lock therein (FIG. 5A), first sliding tube 10 no longer moves up along the second sliding tube 40. Then first sliding tube 10 and second sliding tube 40 together move up until the lock pin 54 of second locking device 50 comes into engagement with middle hole 76 of support tube 70 and locks therein (FIG. 5B). At this time handle is pulled up a small distance above the top of luggage. Similarly, first and second locking device 20 and 50 are unlocked simultaneously when push button 91 is pressed again (FIGS. 6A and 6B). As stated above, locking block 24 moves up to come into engagement with upper hole 45 of second sliding tube 40 (FIGS. 7A and 7B). At this time, handle grip 90 continuously moves up to cause stem member 58 previously caught in the retaining groove 211 of the first housing 21 below the first sliding tube 10 to move up along with first sliding tube 10. Then second sliding tube 40 and second locking device 50 move up until lock pin 54 comes into contact with upper hole 73 and locks therein (FIGS. 8A and 8B). Now handle is in a fully extended position for allowing luggage to be towed along the ground. To the contrary, press push button 91 to retract handle which in turn causes pin 240 of locking block 24 attached to flexible steel cable 22 to escape engagement with upper hole 45 of second sliding tube 40. Whereby first sliding tube 10 may receive within second sliding tube 40 until bottom of first locking device 20 comes into contact with top of sliding block 57. Then upper slopes 574 of sliding block 57 engages with upper slopes 5532 of triangular projections 553 (FIG. 10) to cause lock pin 54 of second locking device 50 to clear upper hole 73 of support tube 70 (FIGS. 9A and 9B). Pin 240 clears upper hole 45 of second sliding tube 40 when push button 91 is pressed again. Then first sliding tube 10 may receive in second sliding tube 40 and second sliding tube 40 may receive in support tube 70. Now the handle is fully retracted (FIGS. 2A and 2B).

Note that the first locking device 20 is a master device and second locking device 50 is a slave one. As such, the number of second locking device 50 may be added in other embodiments. Further, the number of second sliding tube 40 may be added too. As a result, a handle system with multiple locking devices and a plurality of constituent tubes are carried out, thereby enabling handle to extend and lock in one of a plurality of selective positions thereof.

Figure 11:
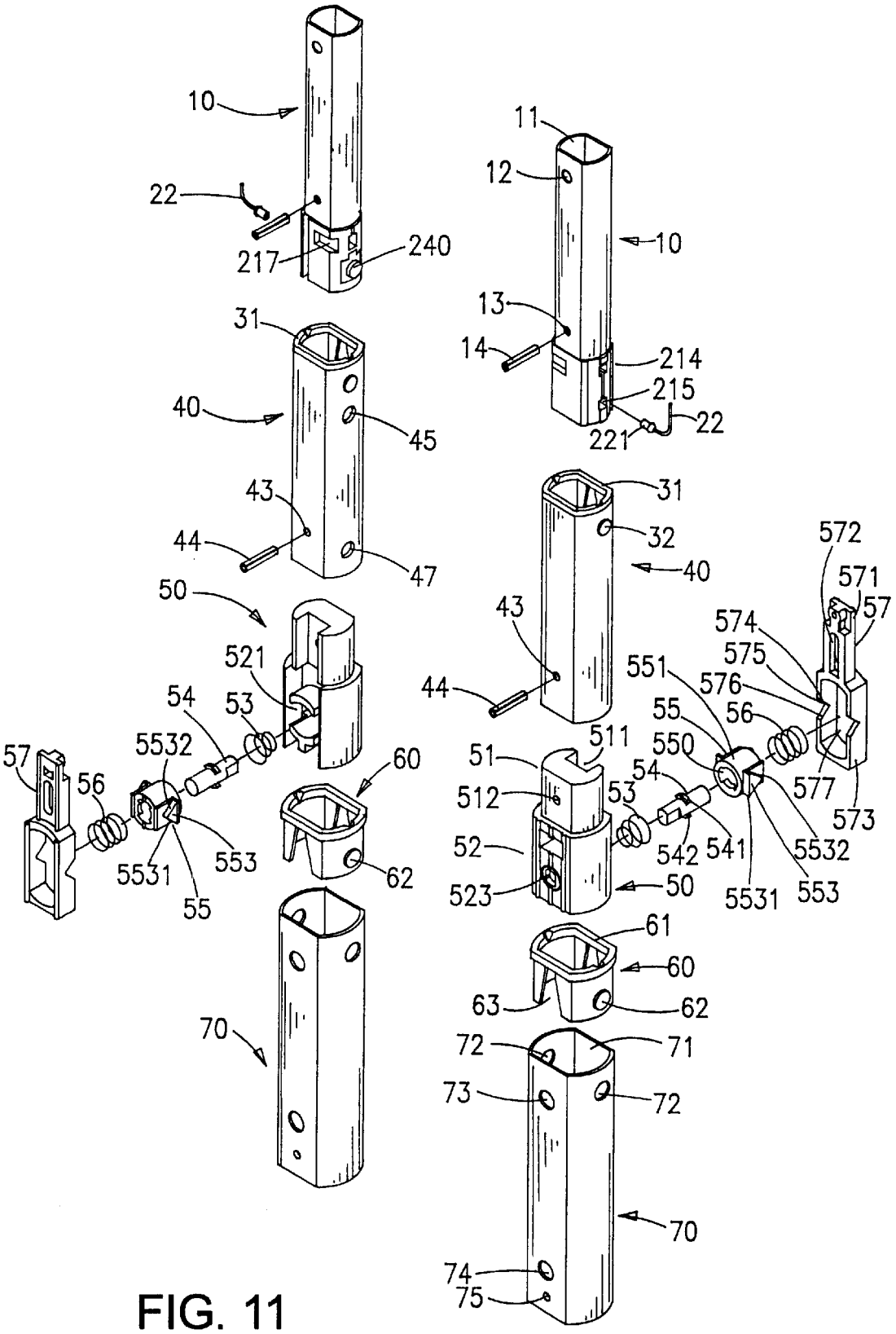
FIG. 11 is an exploded view of a second preferred embodiment of a locking device for retractable handle of wheeled luggage of the invention.

Note that stem member 58, middle hole 46 of second sliding tube 40, and middle hole 73 of support tube 70 may be omitted if the function of extending handle a predetermined distance above the top of luggage is not desirable as shown in FIG. 11 the second preferred embodiment of the invention. This is an aspect of the Invention.

Figure 8B:
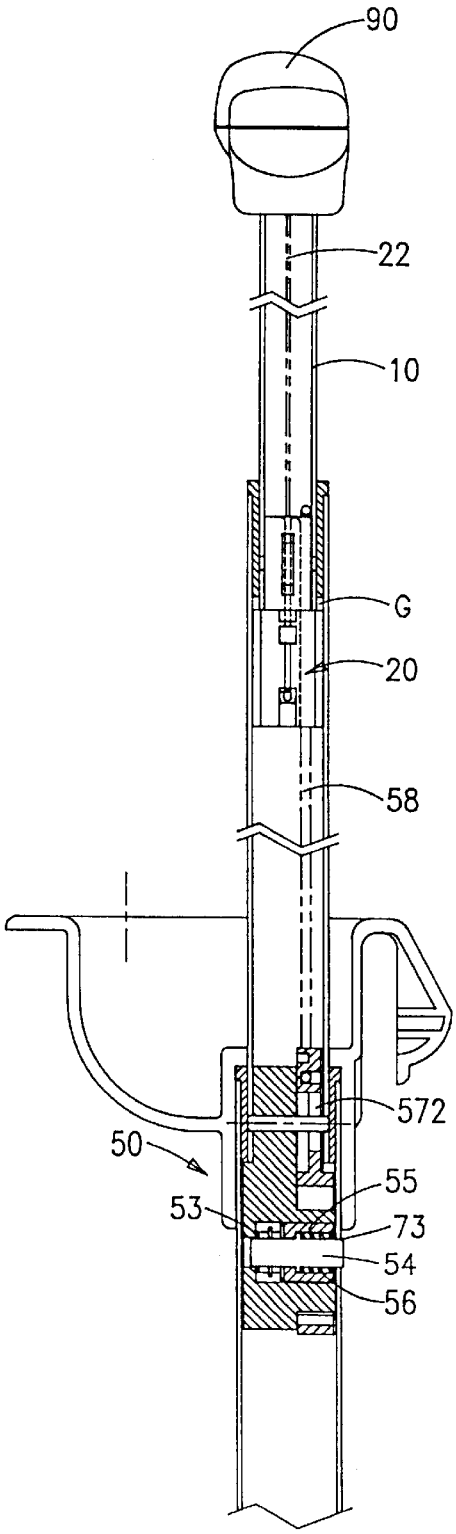
FIGS. 8A and 8B are first and second sectional views respectively showing second locking device locked in upper hole of support tube where handle is fully extended.
Figure 8A:
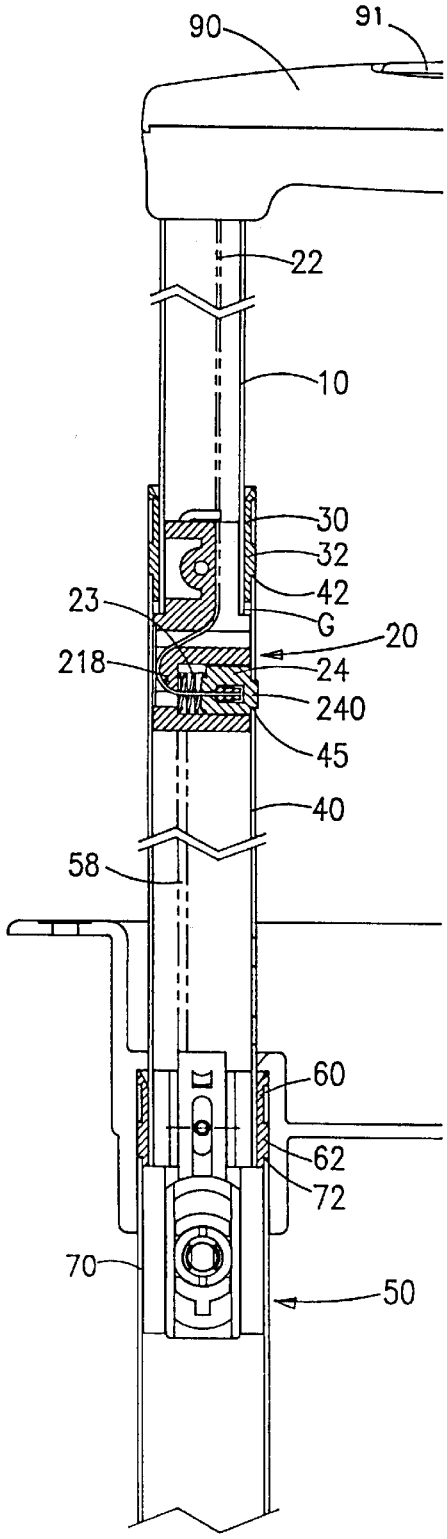

Note that the height of first sleeve member 30 is designed to be less than that of the upper portion 210 of first locking device 20. Such that a gap G is generated between upper portion 210 of first locking device 20 and bottom of first sleeve member 30 when first locking device 20 is pulled to its fully extended position (FIGS. 7A, 7B, 8A, and 8B). Thus second locking device 50 may be unlocked when first and second locking device 20 and 50 both in locked conditions (FIG. 8). Accordingly, the sliding block 57 moves up a small distance to cause lock pin 54 to dear lower hole 73 of support tube 70. This is another aspect of the invention.

Note that actuation mechanism may not be exactly the one as described herein. The only requirement is that a connecting means (flexible steel cable) 22 is attached between push button 91 of handle grip 90 and master locking device 20 for causing a corresponding action when push button 91 is pressed. For example, first locking device 20 may be replaced by a conventional locking device without departing from the scope of the invention. But the space above the housing of first locking device 20 reserved for flexible stem member attached to second locking device 50 is necessary if the function of extending handle a small predetermined distance above the top of luggage is desirable.

Figure 12:
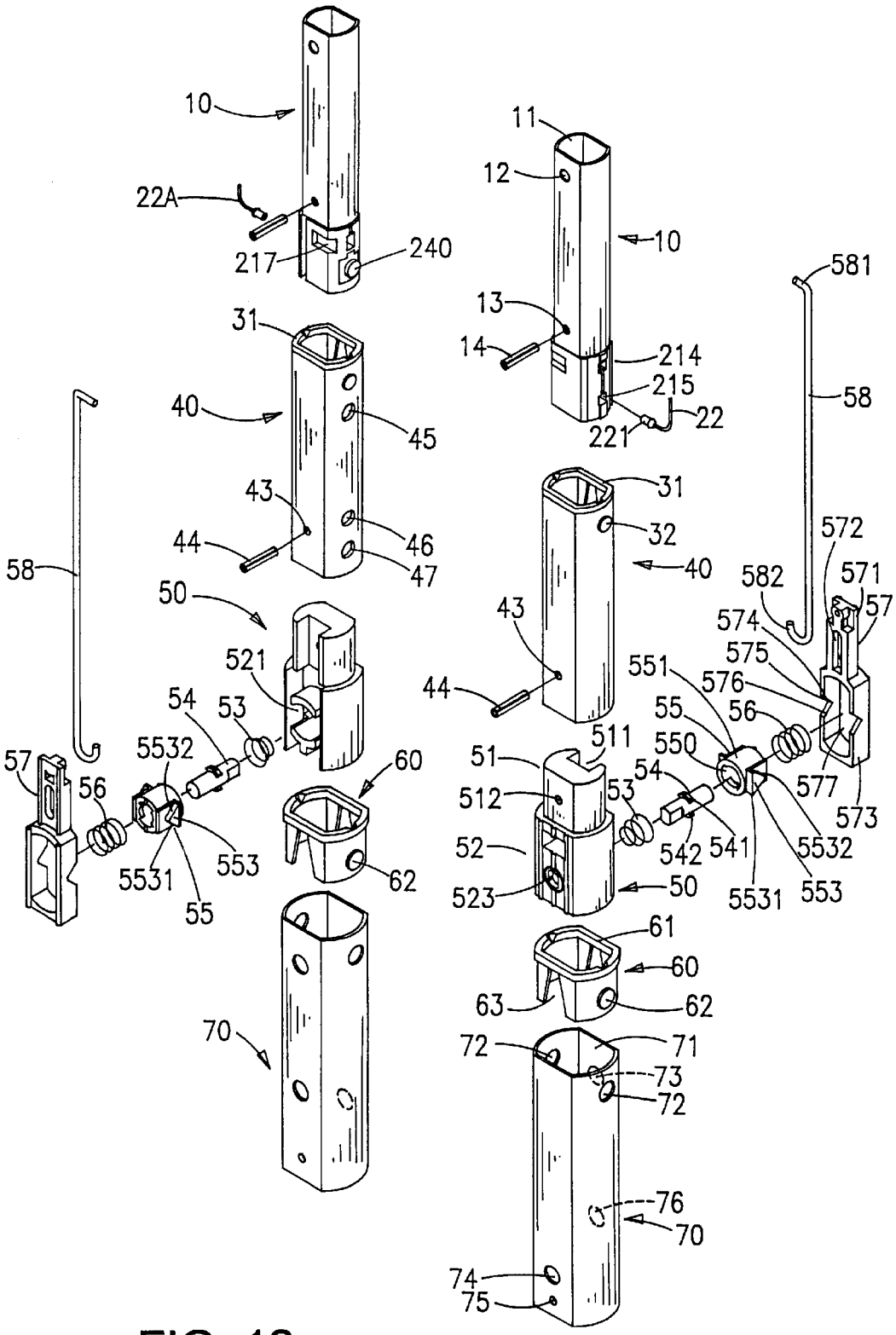
FIG. 12 is an exploded view of a third preferred embodiment of a locking device for retractable handle of wheeled luggage of the invention.

FIG. 12 illustrates a third preferred embodiment of the invention wherein master locking device is a conventional one, while the second locking device 50 is the same as the first and second embodiments. Note that second locking device 50 may be located below one of second sliding tubes 40 (only one is shown) in an implementation of multi-segment handle.

While the invention herein disclosed has been described by means of specific embodiments, numerous modifications and variations could be made thereto by those skilled in the art without departing from the scope of the invention set forth in the claims.

What is claimed is:

1. A handle assembly for wheeled luggage provided on a back of the luggage with a handle received in a bezel on a top of the luggage, the handle assembly comprising:

a pair of first connecting means;

a pair of first sliding tubes connected to the handle;

first locking means detachably attached to bottoms of the first sliding tubes, the first locking means having projections and locking blocks;

a pair of sleeve members;

a pair of stem members;

a pair of second sliding tubes, each having one of the pair of first sliding tubes slidingly movable therein, each second sliding tube having a plurality of first holes;

second locking means detachably attached to bottoms of the second sliding tubes; and a pair of support tubes, each having one of the pair of sliding tubes slidingly movable therein, each support tube having a plurality of second holes, whereby when the handle is pulled up, the pair of first sliding tubes are pulled upward causing the locking blocks of the first locking means to be received in a lower hole of the plurality of first holes, such that the first locking means are separated from the second locking means, whereby the lock pins of the second locking means displace laterally to disengage from lower hole of each of the support tube;

the pair of first sliding tubes move up until the locking blocks of the first locking means move into a middle hole of the plurality of first holes, whereby the first pair of sliding tubes and the second pair of sliding tubes together move up until the second locking means comes into engagement with the middle hole of the plurality of second holes, whereby the handle is pulled up a predetermined distance above the top of the luggage;

when the first and the second locking means are unlocked simultaneously, the locking blocks of the first locking means move up until engaging an upper hole of the plurality of first holes, the handle moves up to cause the pair of second sliding tubes and the second locking means to move up until the second locking means engages an upper hole of the plurality of second holes, whereby the handle is in a fully extended position; and the handle is retracted by causing the locking blocks of the first locking means to escape engagement with the upper hole of the plurality of first holes, whereby the pair of first sliding tubes are received in the pair of second sliding tubes until the first locking means comes into contact with sliding blocks, then the second locking means disengages from the upper hole of the plurality of second holes to cause the second sliding tubes to be received in the support tubes, whereby the handle is fully retracted, wherein each of the second locking means comprises:

a housing having an upper portion having a groove, a pin hole such that a pin inserts through a lower hole of the plurality of first holes and the pin hole to secure the second locking means and the pair of second sliding tubes together, and a lower portion having a central dent and an aperture in a bottom of the dent;

a sliding block being slidable along the groove and the dent, the sliding block having an upper portion with an elongate groove and a lower portion wider than the upper portion, a rectangular recess formed on the lower portion being adjacent the upper portion and having two V-shaped recesses located on opposing sides, each V-shaped recess having a first upper slope and a second lower slope;

a first spring with one end biased against the aperture of the lower portion;

a lock pin slidingly movable in the dent having two opposing projections inserted into the first spring and secured in the aperture;

a sleeve slidingly movable in the dent with one end biased against the first spring, the lock pin slidable in the sleeve, two opposing triangular projections formed on an outer surface of the sleeve engaged with the V-shaped recesses having a second lower slope and a second upper slope;

a second spring on the lock pin being received in the sleeve; and a connecting means having a top end in the retaining groove of the first locking means and a bottom end in the elongate groove.

2. The handle assembly of claim 1 further comprising a gap between an upper portion of the first locking means and bottoms of the pair of sleeve members when the handle is pulled to a fully extended position.

3. The handle assembly of claim 1, further comprising a push button pull the handle up such that when the push button is pressed, the sliding blocks of the second locking means are not biased by the first locking means, the sleeve is pushed in a predetermined direction by expansion of the first spring to cause the lower slopes of the triangular projections to engage against the lower slopes of the sliding blocks to move the sliding blocks up which, in turn, moves the handle up; and when the push button is pressed to retract the handle, the first sliding tubes are received in the second sliding tubes until the first locking means comes into contact with a top of the sliding block of the second locking means, the upper slopes of the sliding block engaging the upper slopes of the triangular projections to cause the lock pins of the second locking means to clear the upper hole of the plurality of second holes, whereby the first sliding tubes are received in the second sliding tubes and the second sliding tubes are received in the support tubes when a continuous pressing of the push button is performed.

4. The handle assembly of claim 1 wherein the first locking means comprises a first housing having an upper portion with a guide groove for guiding a flexible steel cable therethrough, and a retaining groove for retaining the stem member therein.

5. The handle assembly of claim 4 wherein a height of the first sleeve member is less than that of the upper portion of the first locking device means, such that a gap is formed between the upper portion of the first locking device means and a bottom of the sleeve member when the first locking means is pulled to a fully extended position.

6. The handle assembly of claim 4 wherein a top end of the stem member is clung to a retaining groove in the first housing and a bottom end is clung to an elongate groove in a sliding block when the first locking means is at an upper portion of the first sliding tube.

7. A handle assembly for wheeled luggage comprising:

a pair of first connecting means;

a pair of first sliding tubes;

first locking means detachably attached to bottoms of the first sliding tubes, the first locking means having projections and locking blocks;

a pair of sleeve members;

a pair of second sliding tubes, each having one of the first pair of sliding tubes slidingly movable therein, each second sliding tube having a plurality of first holes and a lock pin;

second locking means detachably attached to bottoms of the second sliding tubes; and a pair of support tubes, each having one of the second pair of sliding tubes slidingly movable therein, each support tube having a plurality of second holes, whereby, when the handle is retracted, the pair of first sliding tubes are received in the pair of second sliding tubes and the pair of second sliding tubes are received in the pair of support tubes, the projections of the first locking means engage a lower hole of the plurality of first holes, bottoms of the first locking means are biased against tops of sliding blocks of the second locking means so as to move the lock pins of the second locking means into engagement with a lower hole of the plurality of second holes, whereby the handle is locked in a retracted position;

when the handle is pulled up to pull the pair of first sliding tubes upward, the locking blocks of the first locking means are received in the lower hole of the plurality of first holes such that the pair of first sliding tubes move up for separating the bottoms of the first locking means from the tops of the second locking means, whereby the lock pins of the second locking means are displaced laterally to disengage from the lower hole of the plurality of second holes; and the pair of first sliding tubes move up until the lock blocks of the first sliding tubes moves into a middle hole of the plurality of first holes, the handle continuously moving up to cause the pair of second sliding tubes and the second locking means to move up until the lock pins of the second locking means engage an upper hole of the plurality of second holes, whereby the handle is in a fully extended position, wherein each of the second locking means further comprises:

a housing having an upper portion having a groove, a pin hole such that a pin inserts through the lower hole of the plurality of first holes and the pin hole to secure the second locking means and the second sliding tubes together, and a lower portion having a central dent and an aperture in a bottom of the dent;

a sliding block being slidable along the groove and the dent, the sliding block having an upper portion with an elongate groove and a lower portion wider than the upper portion, a rectangular recess formed on the lower portion being adjacent the upper portion and having two V-shaped recesses located on opposing sides, each V-shaped recess having a first upper slope and a first lower slope;

a first spring with one end biased against the aperture of the lower portion;

a lock pin slidingly movable in the dent having two opposing projections inserted into the first spring and secured in the aperture;

a sleeve slidingly movable in the dent with one end biased against the first spring, the lock pin slidable in the sleeve, two opposing triangular projections formed on an outer surface of the sleeve engaged with the V-shaped recesses having a second lower slope and a second upper slope; and a second spring on the lock pin being received in the sleeve.

* * * * *